US005832742A

United States Patent [19]

Kouri et al.

[11] Patent Number: 5,832,742

[45] Date of Patent: Nov. 10, 1998

[54] ABSORPTION TYPE REFRIGERATOR

[75] Inventors: Yasumichi Kouri, Tokyo; Tomohiro Morita, Kanagawa-ken; Masatoshi Asakawa, Tokyo; Hidetoshi Arima; Norikazu Kubota, both of Gunma-ken, all of Japan

[73] Assignee: Sanyo Electric Co., Ltd., Osaku-fu, Japan

[21] Appl. No.: 846,212

[22] Filed: Apr. 28, 1997

[30] Foreign Application Priority Data

Apr. 30, 1996 [JP] Japan ..... 8-109692

[51] Int. Cl.[6] ..... F25B 33/00

[52] U.S. Cl. ..... 62/497

[58] Field of Search ..... 62/497, 476, 101, 62/148; 431/328, 326, 7, 170

[56] References Cited

U.S. PATENT DOCUMENTS 2,121,948 6/1938 Borland ..... 431/328
5,417,566 5/1995 Ishikawa et al. ..... 431/328

FOREIGN PATENT DOCUMENTS 63-294467 12/1988 Japan .
6221718 8/1994 Japan .

*Primary Examiner*—William Doerrler
*Attorney, Agent, or Firm*—Weingarten, Schurgin Gagnebin & Hayes LLP

[57] ABSTRACT

In a compact absorption type refrigerator which eliminates an ill effect caused by the local overheating of a heating chamber in a high-temperature regenerator with a liquid pipe boiler, a high-temperature regenerator 5 heats a heating chamber 63 in which vertical liquid pipes 51 for circulating a diluted absorption solution 2*a* are arranged in a matrix form with the combustion surface 60D2 of a plane flame type burner 60X to evaporate refrigerant vapor 7*a* from the diluted solution 2*a*. The width 60BX of the combustion surface 60D2 within a horizontal plane is made smaller than the width 51BX of the liquid pipes 51 arranged in a matrix form, the volume of flames on the combustion surface 60D2 within the horizontal plane is made large at a central portion and small at portions on wall 50B sides, or the volume of flames on the combustion surface 60D2 within a vertical plane is made large at an upper portion and small at a lower portion so that the diluted solution 2*a* flows in an upward direction in flow passages 51*a* and a downward direction in flow passages 50*a* and 50*b*.

7 Claims, 11 Drawing Sheets

PRIOR ART

PRIOR ART

PRIOR ART

Fig.8B *PRIOR ART*
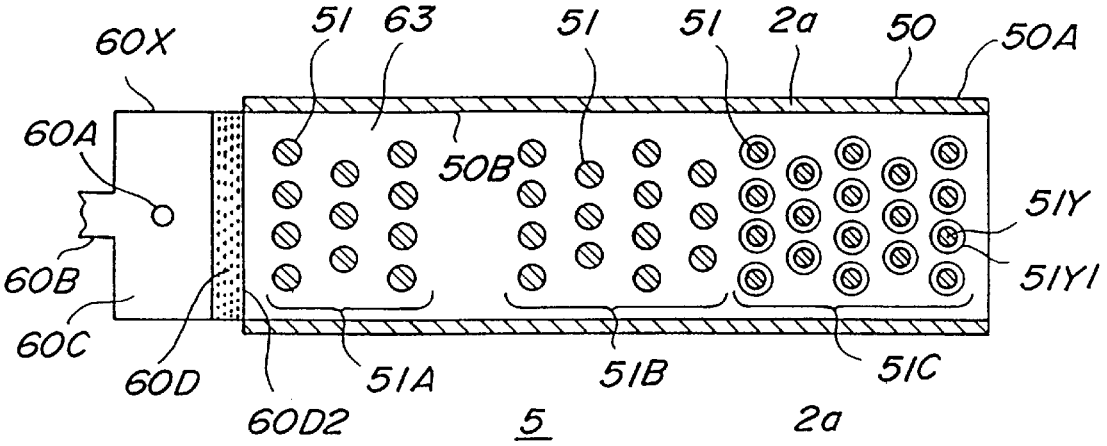
Fig.8C
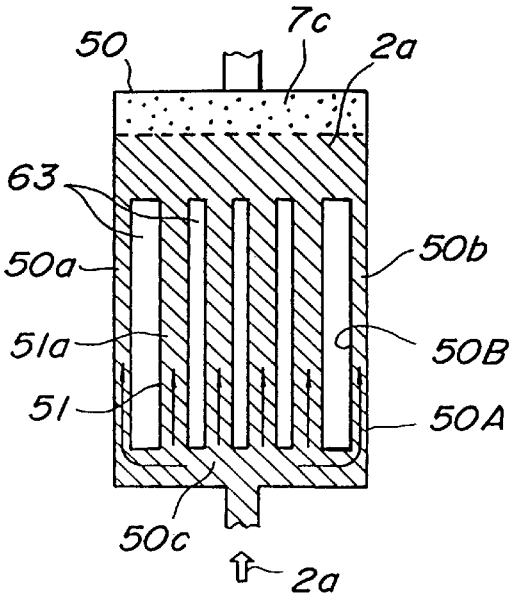
*PRIOR ART*

ABSORPTION TYPE REFRIGERATOR

BACKGROUND OF THE INVENTION

1. Field of the Invention

This invention relates to an absorption type refrigerator in which the heating effect of a high-temperature regenerator is improved.

2. Background Art

There is known an absorption refrigerator 100 as shown in FIG. 5 which uses an absorption solution such as an aqueous solution of lithium bromide prepared by mixing lithium bromide as an absorber and water as a medium.

In FIG. 5, portions shown by bold solid lines are pipe lines of liquids such as a refrigerant solution, an absorption solution and cooling water and portions shown by double lines are pipe lines of refrigerant vapor. A circulation system of the absorption solution is first described with an absorption solution having a low concentration which accumulates in the bottom of an absorber 1, that is, a diluted solution 2*a* as a starting point.

The diluted solution 2*a* enters a high-temperature regenerator 5 through a pipe line 3 by means of a pump P1. Since the high-temperature regenerator 5 is heated by a heater 6 such as a burner from below, a refrigerant contained in the diluted solution 2*a* evaporates and thus the diluted solution 2*a* separates into a high-temperature absorption solution having an intermediate concentration, that is, an intermediate solution 2*b* and refrigerant vapor 7*a*.

The high-temperature intermediate solution 2*b* enters a high-temperature heat exchanger 9 through a pipe line 8. In the heat exchanger 9, the high-temperature intermediate solution radiates heat by providing heat to the diluted solution 2*a* passing through the pipe line 3 to lower its temperature and then enters a low-temperature regenerator 11 through a pipe line 10.

In the low-temperature regenerator 11, since the intermediate solution 2*b* is heated by supplying the refrigerant vapor 7*a* into radiator pipes 11A in the low-temperature regenerator 11 for heating the intermediate solution 2*b* through a pipe line 21, the refrigerant contained in the intermediate solution 2*b* evaporates and thus the intermediate solution 2*b* separates into a high-temperature absorption solution having a high concentration, that is, a concentrated solution 2*c* and refrigerant vapor 7*b*.

The high-temperature concentrated solution 2*c* enters a low-temperature heat exchanger 13 through a pipe line 12. In the heat exchanger 13, the high-temperature concentrated solution 2*c* radiates heat by providing heat to the diluted solution 2*a* passing through the pipe line 3 to lower its temperature to an intermediate temperature, enters a spray unit 1A in the absorber 1 through a pipe line 14, and is sprayed from a large number of holes of the spray unit 1A.

The thus sprayed concentrated solution 2*c* is diluted by absorbing the refrigerant vapor 7*c* coming from an adjacent evaporator 26 when it falls down along the outside of each cooling pipe 1B and is cooled by cooling water 32*a* circulating in the cooling pipe 1B in the absorber 1 to become a low-temperature diluted solution 2*a* again. Thus, one cycle of the circulation of the absorption solution is ended and this cycle is repeated.

A description is subsequently given of the circulation system of the refrigerant with the refrigerant vapor 7*c* which enters the absorber 1 as a starting point. The refrigerant vapor 7*c* is, as described in the circulation system of the absorption solution above, absorbed into the concentrated solution 2*c* sprayed by the spray unit 1A in the absorber 1, contained in the diluted solution 2*a* and separated from the diluted solution 2*a* in the high-temperature regenerator 5 as the refrigerant vapor 7*a*.

The refrigerant vapor 7*a* enters a radiation pipe 11A in the low-temperature regenerator 11 through a pipe line 21, radiates heat by providing heat to the intermediate solution 2*b*, is condensed into a refrigerant solution 24*a*, and enters the bottom of a condenser 23 through a pipe line 22.

The condenser 23 cools the refrigerant vapor 7*b* coming through a large number of passages 11B between the condenser 23 and the adjacent low-temperature regenerator 11 with cooling water 32*a* passing through a cooling pipe 23A in the condenser 23 to condense the refrigerant vapor 7*b* into a low-temperature refrigerant solution 24*a*. The refrigerant solution 24*a* enters the evaporator 26 through a pipe line 25 and accumulates in the bottom of the evaporator 26 as a refrigerant solution 24*b*.

A pump P2 supplies the refrigerant solution 24*b* to the spray unit 26A through a pipe line 28 and sprays it from a large number of holes in the spray unit 26A repeatedly. The sprayed refrigerant solution 24*b* cools a heat operated fluid passing through a heat exchanger 26B in the evaporator 26, that is, return cold or hot water 35*a*. During cooling, the refrigerant solution 24*b* evaporates by absorbing heat from the return cold or hot water 35*a* to become refrigerant vapor 7*c*, passes through a large number of passages 26C between the evaporator 26 and the adjacent absorber 1, and returns to the absorber 1. Thus one cycle of the circulation of the refrigerant is ended and this cycle is repeated.

By the above operation, double-effect cooling is carried out by the double regeneration operation of the high-temperature regenerator 5 and the low-temperature regenerator 11 in such a manner that, while the absorption solution and the refrigerant, that is, the heat operation fluids are circulated, a heat operated fluid supplied from the pipe line 36, that is, return cold or hot water 35*a* is cooled by the heat exchange pipe 26B in the evaporator 26, i.e., a heat exchange pipe, and cold or hot water 35*b* is supplied from the pipe line 37 to a cooling load such as a cooling unit, i.e., an indoor cooling unit as a heat operated fluid for cooling. The cooling load is mainly used for cooling.

The return cooling water 32*b* obtained after the cooling water 32*a* is heated by cooling each target site passes through a pipe line 34, is supplied to a radiator such as a cooling tower for air cooling or an air-cooled heat exchanger, radiates heat and becomes low-temperature cooling water 32*a* again.

The absorption type refrigerator 100 is configured to carry out double-effect cooling as described above. As shown by dotted lines in FIG. 5, a switch valve V1 provided in a pipe line 41 for supplying the refrigerant vapor 7*a* evaporated in the high-temperature regenerator 5 and the high-temperature intermediate solution 2*b* to be supplied into the high-temperature heat exchanger 9 to the evaporator 26 is opened to return them to the evaporator 26 directly and a switch valve V2 provided in a pipe line 43 connected to the pipe lines 28 and 3 is opened to mix the refrigerant solution 24*b* which accumulates in the bottom of the evaporator 26 with the absorption solution 2*a*. Thereby, without using the low-temperature regenerator 11, the heat operated fluid, i.e., return cold or hot water 35*a* supplied from the pipe line 36 is heated by a heat exchange pipe 26B, i.e., heat exchange pipe in the evaporator 26 and hot water is supplied in place of cold water while the circulation of the absorption solution and the circulation of the refrigerant are carried out by the operation of the high-temperature regenerator 5 only. By adding this configuration, the cooling load 210 is changed into a heating load and mainly used for heating.

There is a cold and hot water supply refrigerator in which, in the above configuration for carrying out double-effect cooling, a heat exchanger 81 is provided along a pipe line 21 of the refrigerant vapor 7*b* to heat return hot water 82*a* returned by heating the heating load through heat exchange with the refrigerant vapor 7*b* and supply it as hot water 82*b*, whereby the cold or hot water 35*b* in the pipe 37 is supplied to the cooling load as a cooling heat source while hot water 82*b* is supplied to the heating load as a heating heat source.

A control unit 70 of the absorption type refrigerator 100 is structured such that it carries out required control processing based on detection signals obtained by detecting the state of each required element and operation signals provided from an operation unit (not shown) for inputting operation conditions and carries out target operation by supplying control signals to elements to be controlled.

Laid-open Japanese Patent Application No. Sho 63-294467 and Laid-open Japanese Patent Application No. Hei 6-221718 disclose a liquid pipe type boiler (to be referred as "first prior art" hereinafter) as shown in FIGS. 6A to 6C as the high-temperature regenerator 5 used in this absorption type refrigerator 100.

In FIGS. 6A to 6C, portions shown by bold lines are thick portions of structural members and formed of a plate or pipe made of a metal material such as stainless steel. Hatched portions shown by oblique lines are portions storing the diluted solution 2*a*.

A nozzle type burner 60 equivalent to the heater 6, that is, an end mixture gas burner burns a mixture gas consisting of fuel gas 60A and air 60B at an end of a nozzle 61. Heat energy based on this combustion flame 62 is provided to the interior wall 50B of a container 50 enclosing a heating chamber 63 and vertical liquid pipes 51 provided in the heating chamber 63 and then exhausted from an exhaust passage 64 as an exhaust gas.

The diluted solution 2*a* flows into the container 50 enclosing the heating chamber 63 from an inflow pipe 52, is stored in the space between the exterior wall 50A and the interior wall 50B of the container 50 and the insides of the liquid pipes 51 disposed in a staggered matrix form as shown in the section a—a, and receives heating energy based on the flame 62 to evaporate the refrigerant vapor 7*a*. The refrigerant vapor 7*a* stays in the space above the container 50 and flows out from a pipe line 21 and the intermediate solution 2*b* having a high concentration by evaporating the refrigerant vapor 7*a* flows out to a pipe line 8. Since the just evaporated refrigerant vapor 7*a* contains a droplet absorption solution component, an outflow route is bypassed by a bypassing plate 54 to discharge only the refrigerant vapor 7*a* into the pipe line 21.

Laid-open Japanese Patent Application No. Sho 63-294467 discloses the configuration of a high-temperature regenerator in which the heating chamber 63 is formed like a folded path, the liquid pipes 51 are arranged on the folded side of the path, and fins for improving heat absorption, that is, heat absorption fins 51X1 are provided in each of the liquid pipes 51 located in a rear portion of the path.

Laid-open Japanese Patent Application No. Hei 6-221718 discloses the configuration of a high-temperature regenerator in which the liquid pipes 51 are flat liquid pipes which extend along the heating path of the heating chamber 63 and heat absorption fins are provided in a rear portion of each of the flat liquid pipes 51.

FIG. 40 of Volume 12 of Kikai Kogaku Binran published by the Japan Society of Mechanical Engineering in June 1960 shows the configuration of FIG. 7 (to be referred to as "second prior art" hereinafter) as one of end mixture gas burners usable as the heater 6.

In FIG. 7, portions shown by bold lines are thick portions of a structural member which is generally a metal material such as a stainless steel plate and hatched portions shown by crossover lines are the cross sections of fire-proof blocks 60D having a porous surface.

The fuel gas 60A is mixed with air 60B containing oxygen in an amount required for combustion in a mixing chamber 60C to become a mixture gas which is caused to pass through guide pores 60D1 in the fire-proof blocks 60D having a porous surface and burst into a large number of plane flames on a combustion surface 60D2 on the exterior sides of the fire-proof blocks 60D. The flames form a burner 60X (referred to as "plane flame type burner" in this invention) distributed in a plane form.

The fire-proof blocks 60D having a porous surface are mainly formed of a fire-proof thick plate material such as a titanium alloy having a large number of guide pores 60D1 as shown in the figure.

There is proposed the configuration of a high-temperature regenerator 5 in which the plane flame type burner 60X of the above second prior art is provided in place of the nozzle type burner 60 of the above first prior art, that is, end mixture gas burner, as shown in FIGS. 8A to 8C.

In FIGS. 8A to 8C, though the plane flame type burner 60X equivalent to the heater 6 has the same structure as in FIG. 7, for example, the guide pores 60D in the fire-proof block 60D having a porous surface are omitted in the figure.

For the arrangement of the liquid pipes 51, a group of liquid pipes 51 arranged the closest to the combustion surface 60D2 are made the first group 51A, a group of liquid pipes 51 arranged the farthest from the combustion surface 60D2 are made a third group 51C, and a group of liquid pipes 51 interposed between the first and third groups are made a second group 51B.

A partition 50C is located at a position between the first group 51A and the second group 51B for separating the exterior wall 50A of the bottom side of the container 50 from the interior wall 50B. The diluted solution 2*a* supplied by the pump P1 flows in an upward direction in all of flow passages 51*a* in the liquid pipes 51 and flow passages between the exterior walls 50A and the interior walls 50B, that is, flow passages 50*a* and 50*b* on the wall sides and a flow passage 50*c* on the bottom side in the first group 51A of liquid pipes as shown by arrows in the section B—B and heads towards the second group 51B and the third group 51C of liquid pipes from an upper portion of the container 50.

Since heating is carried out in the third group 51C of liquid pipes after most of the heat energy is lost in the first group 51A and the second group 51B of liquid pipes, the flow rate of the diluted solution 2*a* is reduced with liquid pipes 51Y having a small diameter and the amount of heat absorbed is increased with heat absorption fins 51Y1 provided on each of the liquid pipes 51Y.

In the configuration of the high-temperature regenerator 5 according to the above first prior art, since the nozzle type burner 60, that is, an end mixture type gas burner is used, a flame 62 inevitably converges into a long flame, and in such a configuration that the liquid pipes 51 for circulating the diluted solution 2*a* are not in direct contact with a flame 62, the flame is cooled and an unburnt gas remains. Therefore, it is difficult to reduce the size of the entire absorption type refrigerator.

To reduce the size of the entire absorption type refrigerator, as shown in the above third prior art, the plane flame type burner 60X is provided and the liquid pipes 51 are arranged in the vicinity of the plane flame type burner 60X. In this high-temperature regenerator, the diluted solution 2*a* in the flow passages 50*a* and 50*b* between the interior walls 50A and the exterior walls 50B and the diluted solution 2*a* in the flow passages 51*a* in the liquid pipes 51 flow in an upward direction as shown by arrows in the section B—B of FIG. 8A as the diluted solution 2*a* in the flow passages 50*a* and 50*b* and the diluted solution 2*a* in the flow passage 51*a* are heated in the same heating condition. Therefore, the third prior art has such inconvenience that a corrosion accident caused by a rise in temperature occurs in the whole or part of the high-temperature regenerator.

It has been desired to provide a compact and inexpensive absorption type refrigerator structured such that the above inconvenience is eliminated and the flow of the diluted solution 2*a* is well balanced.

SUMMARY OF THE INVENTION

The above problem has been solved by the present invention. That is, according to a first aspect of the present invention, there is provided an absorption type refrigerator in which refrigerant vapor is evaporated from a diluted absorption solution by heating a heating chamber in which vertical liquid pipes for circulating the diluted absorption solution are arranged in a matrix form within a horizontal plane with the combustion surface of a plane flame type burner, the refrigerator comprising a combustion surface forming means for forming the combustion surface such that the width of the combustion surface within the horizontal plane is made smaller than the width of the liquid pipes arranged in a matrix form to prevent the heating chamber from overheating.

According to a second aspect of the present invention, there is provided an absorption type refrigerator which comprises a combustion surface forming means for forming the combustion surface such that the volume of flames on the combustion surface within the horizontal plane is made large at a central portion and small at portions on wall sides to prevent the heating chamber from overheating in place of the combustion surface forming means of the first aspect.

According to a third aspect of the present invention, there is provided an absorption type refrigerator which comprises a combustion surface forming means for forming the combustion surface such that the volume of flames on the combustion surface within the horizontal plane is made large at a central portion and is reduced stepwise from the central portion to portions on the wall sides to prevent the heating chamber from overheating in place of the combustion surface forming means of the first aspect.

According to a fourth aspect of the present invention, there is provided an absorption type refrigerator which comprises a combustion surface forming means for forming the combustion surface such that the volume of flames on the combustion surface within the horizontal plane is made large at a central portion and is reduced gradually from the central portion to portions on the wall sides to prevent the heating chamber from overheating in place of the combustion surface forming means of the first aspect.

According to a fifth aspect of the present invention, there is provided an absorption type refrigerator which comprises a combustion surface forming means for forming the combustion surface such that the volume of flames on the combustion surface within a vertical plane is made large at an upper portion and small at a lower portion to prevent the heating chamber from overheating in place of the combustion surface forming means of the first aspect.

According to a sixth aspect of the present invention, there is provided an absorption type refrigerator which comprises a combustion surface forming means for forming the combustion surface such that the volume of flames on the combustion surface within the vertical plane is made large from a central portion to an upper portion and is reduced stepwise from the central portion to a lower portion to prevent the heating chamber from overheating in place of the combustion surface forming means of the first aspect.

According to a seventh aspect of the present invention, there is provided an absorption type refrigerator which comprises a combustion surface forming means for forming the combustion surface such that the volume of flames on the combustion surface within the vertical plane is made large from a central portion to an upper portion and is reduced gradually from the central portion to a lower portion to prevent the heating chamber from overheating in place of the combustion surface forming means of the first aspect.

The above and other objectives, features and advantages of the invention will become more apparent from the following description when taken in conjunction with the accompanying drawings.

BRIEF DESCRIPTION OF THE DRAWINGS

FIGS. 1A to 4B show preferred embodiments of the present invention and FIGS. 5 to 8C show the prior art.

FIGS. 1A, 1B and 1C are front longitudinal sectional view, plan transverse sectional view and side longitudinal sectional view of key parts, respectively;

FIG. 2 is a plan transverse sectional view of key parts;

FIG. 3 is a front longitudinal sectional view;

FIGS. 4A and 4B are front longitudinal sectional view and side longitudinal sectional view of key parts, respectively;

FIG. 5 is a block diagram of a whole apparatus;

FIG. 7 is a front longitudinal sectional view of key parts; and

FIGS. 8A, 8B and 8C are front longitudinal sectional view, plan transverse sectional view and side longitudinal sectional view of key parts, respecitively.

DETAILED DESCRIPTION OF THE PREFERRED EMBODIMENTS

Figure 8A:
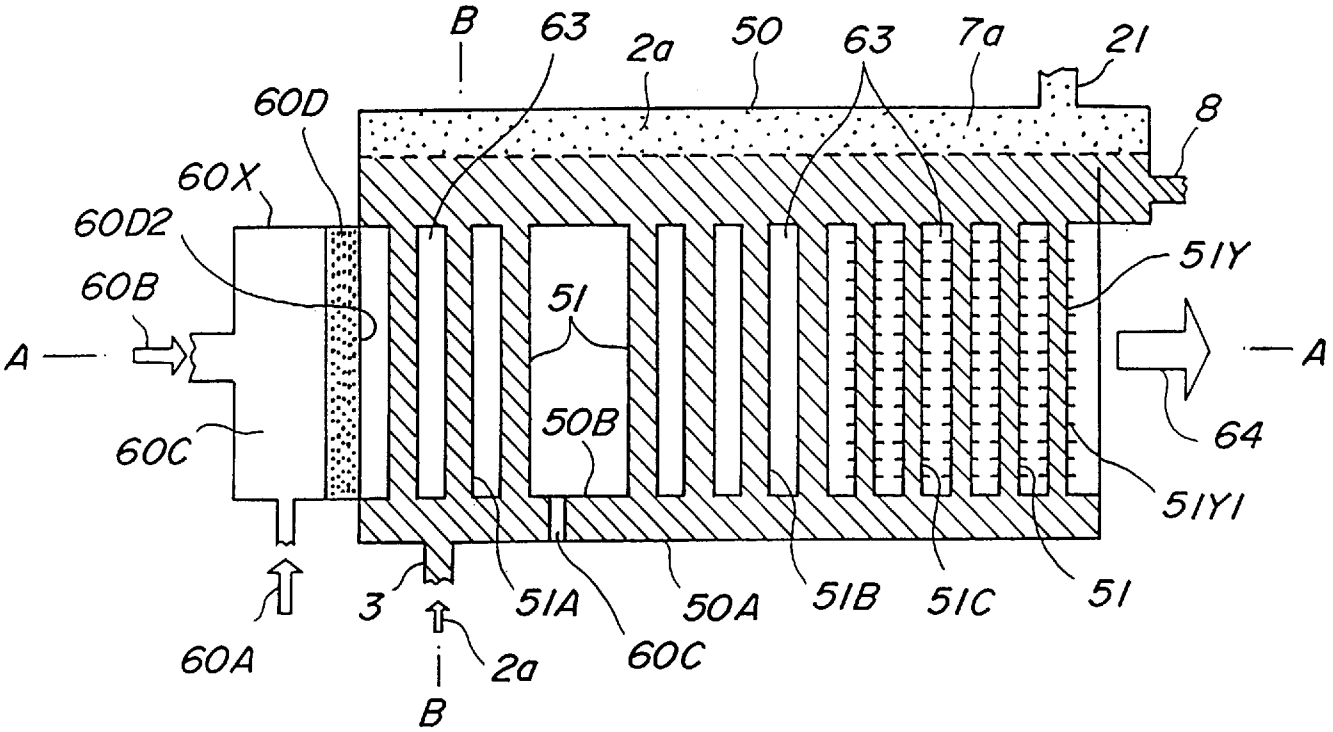

An absorption type refrigerator according to preferred embodiments of the present invention which is applied to the high-temperature regenerator 5 as shown in FIGS. 8A to 8C are described hereinunder.

The above embodiments of the present invention are described with reference to FIGS. 1A to 4B. In FIGS. 1A to 4B, portions denoted by the same reference symbols as in FIGS. 5 to 8C have the same functions as those denoted by the same reference symbols in FIGS. 5 to 8C. In FIGS. 1A to 4B, portions denoted by the same reference symbols have the same functions as those denoted by the same reference symbols escribed in any one of FIGS. 1A to 4B.

[First Embodiment Of Plane Flame Type Burner]

Figure 1A:
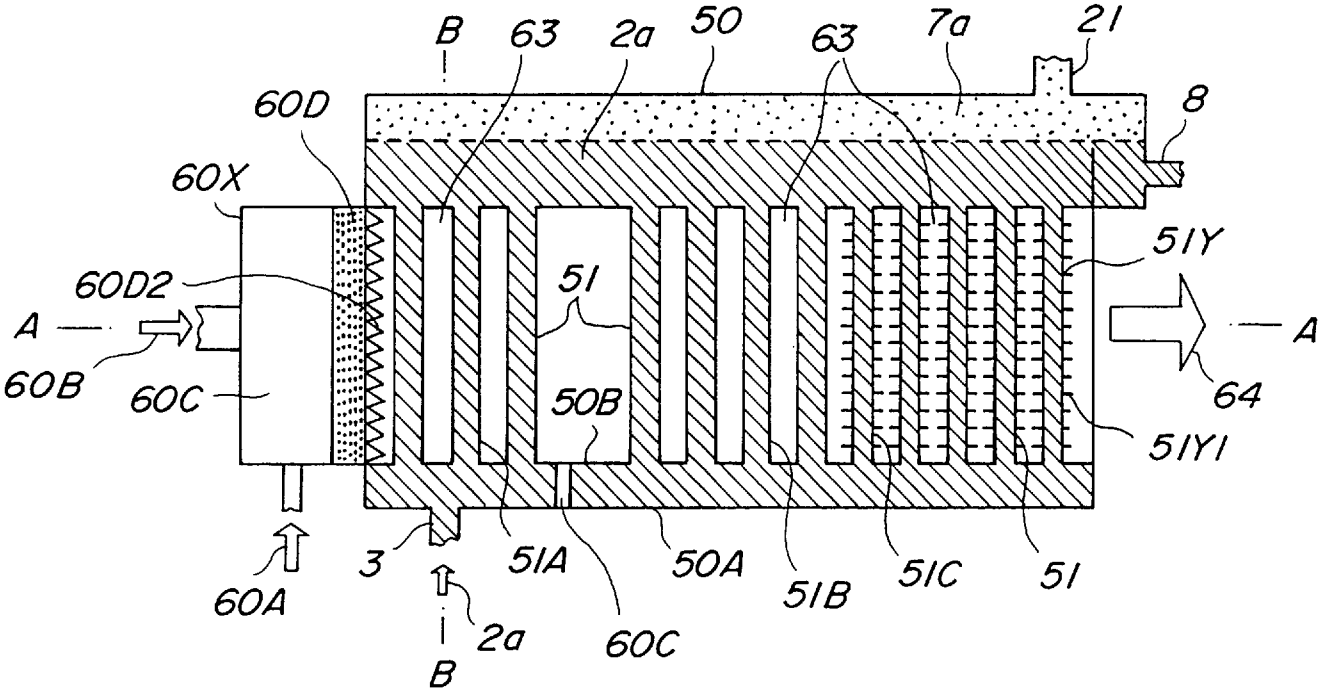
Figure 1B:
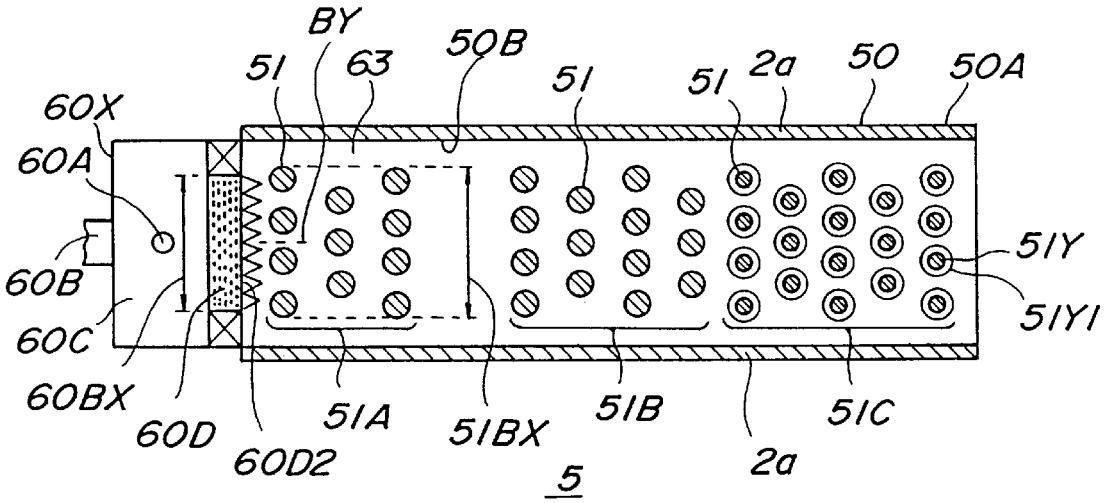
Figure 1C:
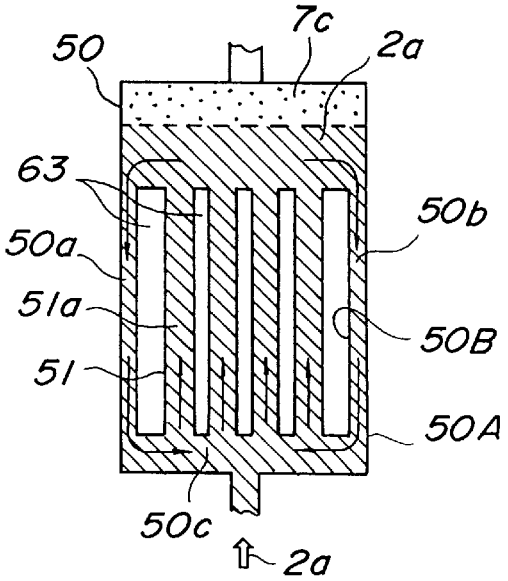

A first embodiment of the plane flame type burner is described with reference to FIGS. 1A to 1C. The difference of the configuration of FIGS. 1A to 1C from the configuration of FIGS. 8A to 8C is that the width 60BX of the combustion surface 60D2 of the plane flame type burner 60X is made smaller than the width 51BX of the liquid pipes 51 arranged in a matrix form within a horizontal plane to prevent flames from the combustion surface 60D2 from heating the interior walls 50B on both sides directly.

According to this configuration, since the diluted solution 2*a* passing through the flow passages 50*a* and 50*b* between the interior walls 50B and the exterior walls 50A on both sides are not locally heated intensely, it flows in an upward direction in the flow passages 51*a* in the first group 51A of liquid pipes as shown by arrows in the section B—B and in a downward direction in the flow passages 50*a* and 50*b*. Thus, the diluted solution 2*a* flows in a well-balanced manner, thereby making it possible to prevent a corrosion accident caused by a local rise in temperature.

[Second Embodiment Of Plane Flame Type Burner]

Figure 2:
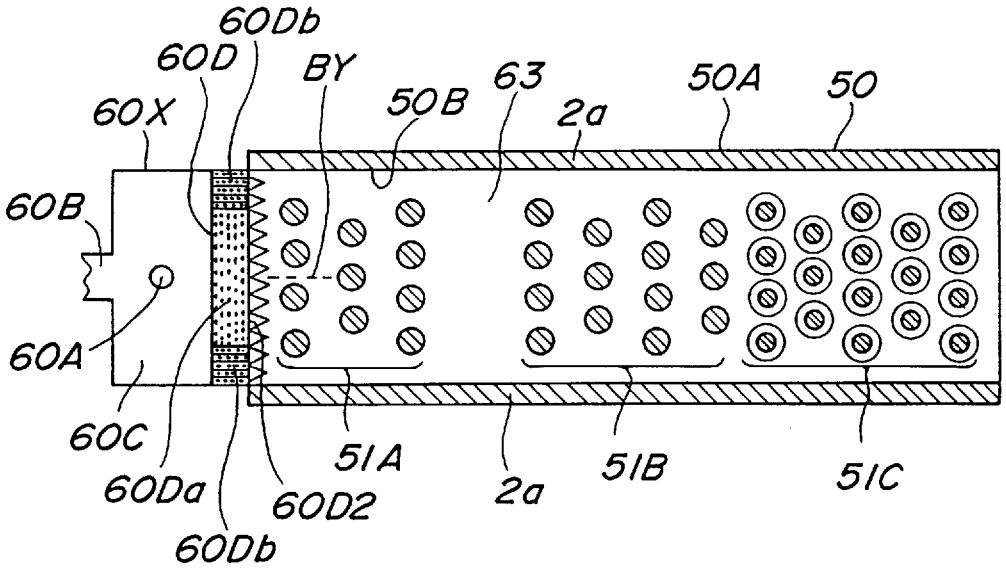

A second embodiment of the plane flame type burner is described with reference to FIG. 2. FIG. 2 shows a constituent portion corresponding to the section a—a of FIG. 8A, that is, a constituent portion within a horizontal plane. The difference of the configuration of FIG. 2 from the configuration of FIG. 8A is that the volume of flames on the combustion surface 60D2 of the plane flame type burner 60X is made large at a central portion BY and is reduced stepwise from the central portion BY to portions on the sides of walls, that is, the interior walls 50B.

More specifically, in a porous surface fire-proof block portion 60Da located at the center, for example, the number of guide pores 60D1 per unit area in FIGS. 8A to 8C is made large or the diameter of each of the guide pores is made large to increase the volume of flames on the combustion surface 60D2. On the other hand, in a porous surface fire-proof block portion 60Db located on both sides of the portion 60Da, the number of guide pores 60D1 per unit area is made small or the diameter of each of the guide pores 60D1 is made small to reduce the volume of flames on the combustion surface 60D2. Thus, the volume of flames can be changed in two steps. When the density of the guide pores 60D1 or the diameter of each of the guide pores 60D1 is changed in more steps, the volume of flames can be changed in more steps.

According to this configuration, since the amount of heating can be made small only for the interior walls 50*b* on both sides, the diluted solution 2*a* flowing through the flow passages 50*a* and 50*b* between the interior walls 50B and the exterior walls 50A is not locally heated intensely. Therefore, as shown by arrows in the section B—B of FIG. 1A, the diluted solution 2*a* flows in an upward direction in the flow passages 50*a* in the first group 51A of liquid pipes and a downward direction in the flow passages 50*a* and 50*b*. Thus, the diluted solution 2*a* can flow in a well-balanced manner, thereby making it possible to prevent a corrosion accident caused by a local rise in temperature.

[Third Embodiment of Plane Flame Type Burner]

A third embodiment of the plane flame type burner is described based on the second embodiment shown in FIG. 2. In the third embodiment, the density of the guide pores 60D1 or the diameter of each of the guide pores 60D1 in the second embodiment of FIG. 2 is reduced for each block from the central portion to portions on the sides of walls. Thus, the volume of flames on the combustion surface 60D2 of the plane flame type burner 60X can be made large at the central portion BY and is reduced gradually from the central portion BY to portions on the sides of walls, that is, the interior walls 50B.

According to this configuration, since the amount of heating can be made small only for the interior walls 50B on both sides as in the third embodiment, the diluted solution 2*a* flowing through the flow passages 50*a* and 50*b* between the exterior walls 50A and the interior walls 50B is not locally heated intensely. Therefore, as shown by arrows in the section B—B of FIG. 1A, the diluted solution 2*a* flows in an upward direction in the flow passages 50*a* in the first group 51A of liquid pipes and a downward direction in the flow passages 50*a* and 50*b*. Thus, the diluted solution 2*a* can flow in a well-balanced manner, thereby making it possible to prevent a corrosion accident caused by a local rise in temperature.

[Fourth Embodiment Of Plane Flame Type Burner]

Figure 3:
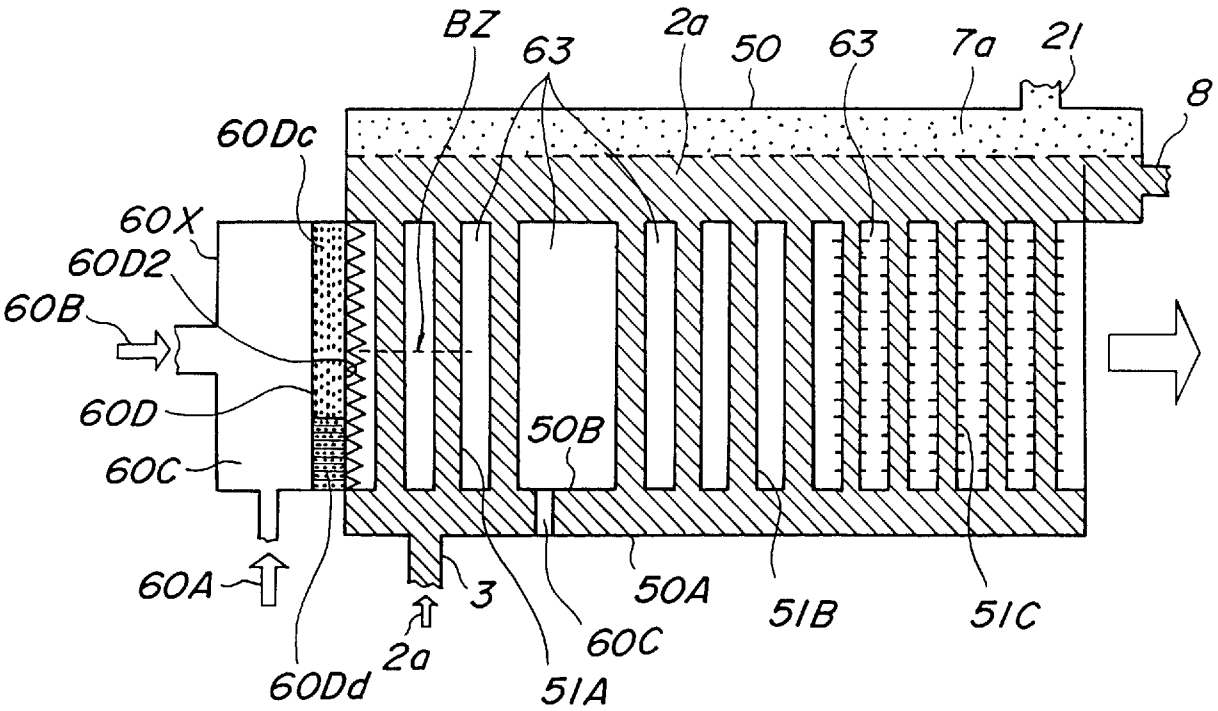

A fourth embodiment of the plane flame type burner is described with reference to FIG. 3. FIG. 3 shows a constituent portion corresponding to FIG. 8A, that is, a constituent portion within a vertical plane. The difference of the configuration of FIG. 3 from the configuration of FIGS. 8A to 8C is that the volume of flames on the combustion surface 60D2 of the plane flame type burner 60X is made larger from a central portion BZ to an upper portion and is reduced stepwise from the central portion to a lower portion, that is, toward the interior wall 50B on the bottom side.

More specifically, in the porous surface fire-proof block portion 60Dc located from the central portion to the upper portion, the number of the guide pores 60D1 per unit area in FIG. 8A is made large or the diameter of each of the guide pores 60D1 is made large to increase the volume of flames on the combustion surface 60D2. On the other hand, in the-porous surface fire-proof block portion 60Dd located from the central portion to the lower portion, the number of the guide pores 60D1 per unit area is made small or the diameter of each of the guide pores 60D1 is made small to reduce the volume of flames on the combustion surface 60D2. Thus, the volume of flames can be changed in two steps. When the density of the guide pores 60D1 or the diameter of each of the guide pores 60D1 is changed in more steps, the volume of flames can be changed in more steps.

According to this configuration, since the amount of heating can be made small only for the flow passage 50*c* on the bottom side, the diluted solution 2*a* flowing through the flow passage 50*c* between the exterior wall 50A and the interior wall 50B is not locally heated intensely. Therefore, the diluted solution 2*a* can flow in a well-balanced manner without an obstruction to the flow of the diluted solution 2*a* caused by local boiling in the flow passage 50*c* on the bottom side, thereby making it possible to prevent a corrosion accident caused by a local rise in temperature.

[Fifth Embodiment Of Plane Flame Type Burner]

A fifth embodiment of the plane flame type burner is configured such that the density of the guide pores 60D1 or the diameter of each of the guide pores 60D1 in the fourth embodiment is reduced from the central portion to the lower portion, for example, for each block to reduce gradually the volume of flames on the combustion surface 60D2 of the plane flame type burner 60X from the central portion BZ to the lower portion, that is, toward the interior wall 50B on the bottom side.

According to this configuration, since the amount of heating can be made small only for the flow passage 50*c* on the bottom side as in the fourth embodiment, the diluted solution 2*a* can flow in a well-balanced manner without an obstruction to the flow of the diluted solution 2*a* caused by local boiling in the flow passage 50*c* on the bottom side.

[Embodiment of Absorption Solution Inflow Passage]

Figure 4A:
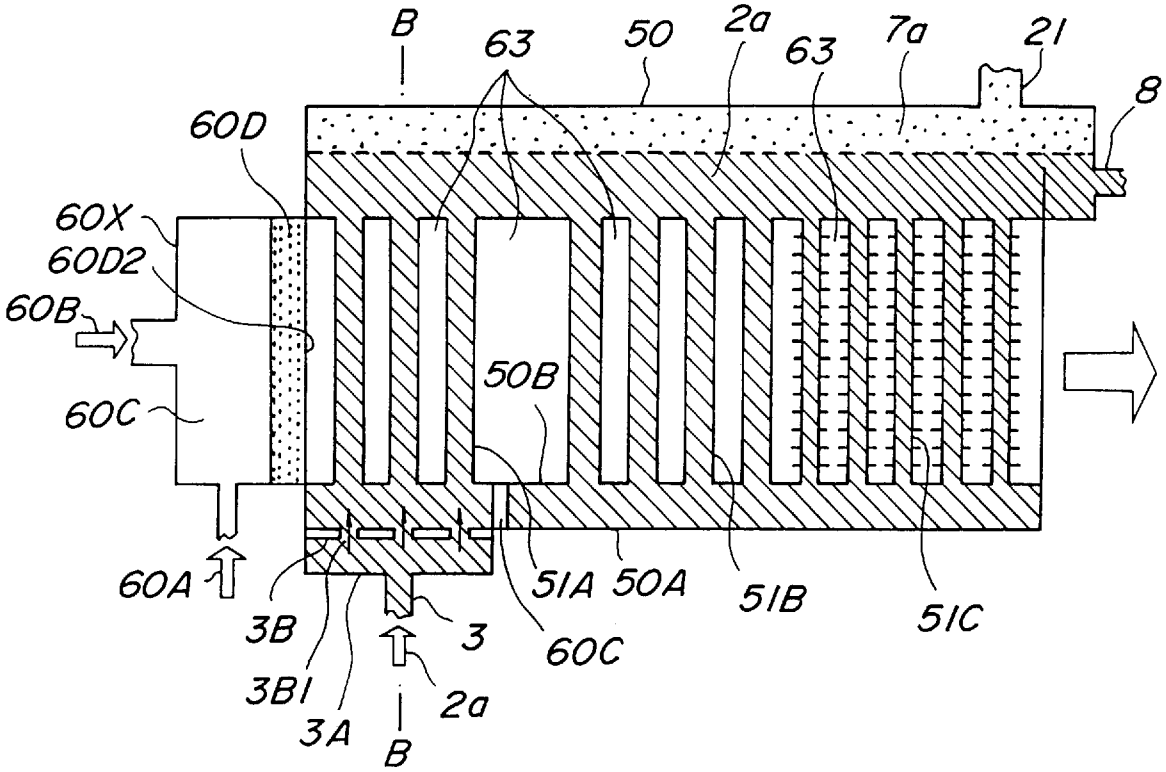
Figure 4B:
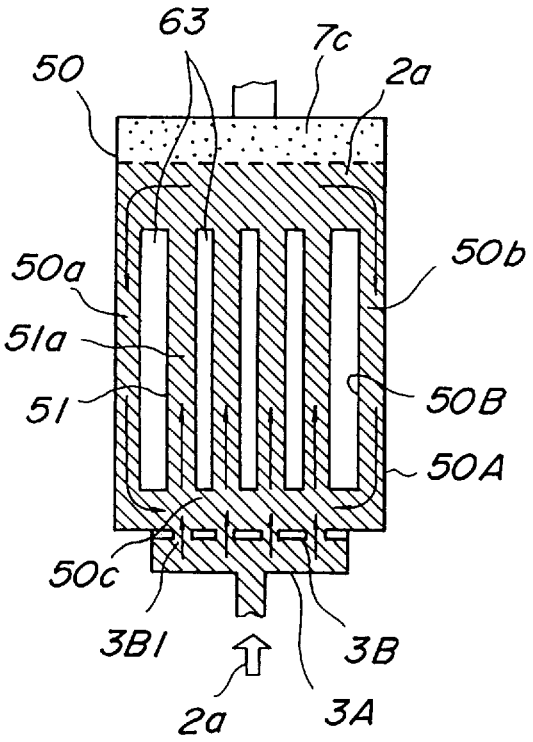
Figure 5:
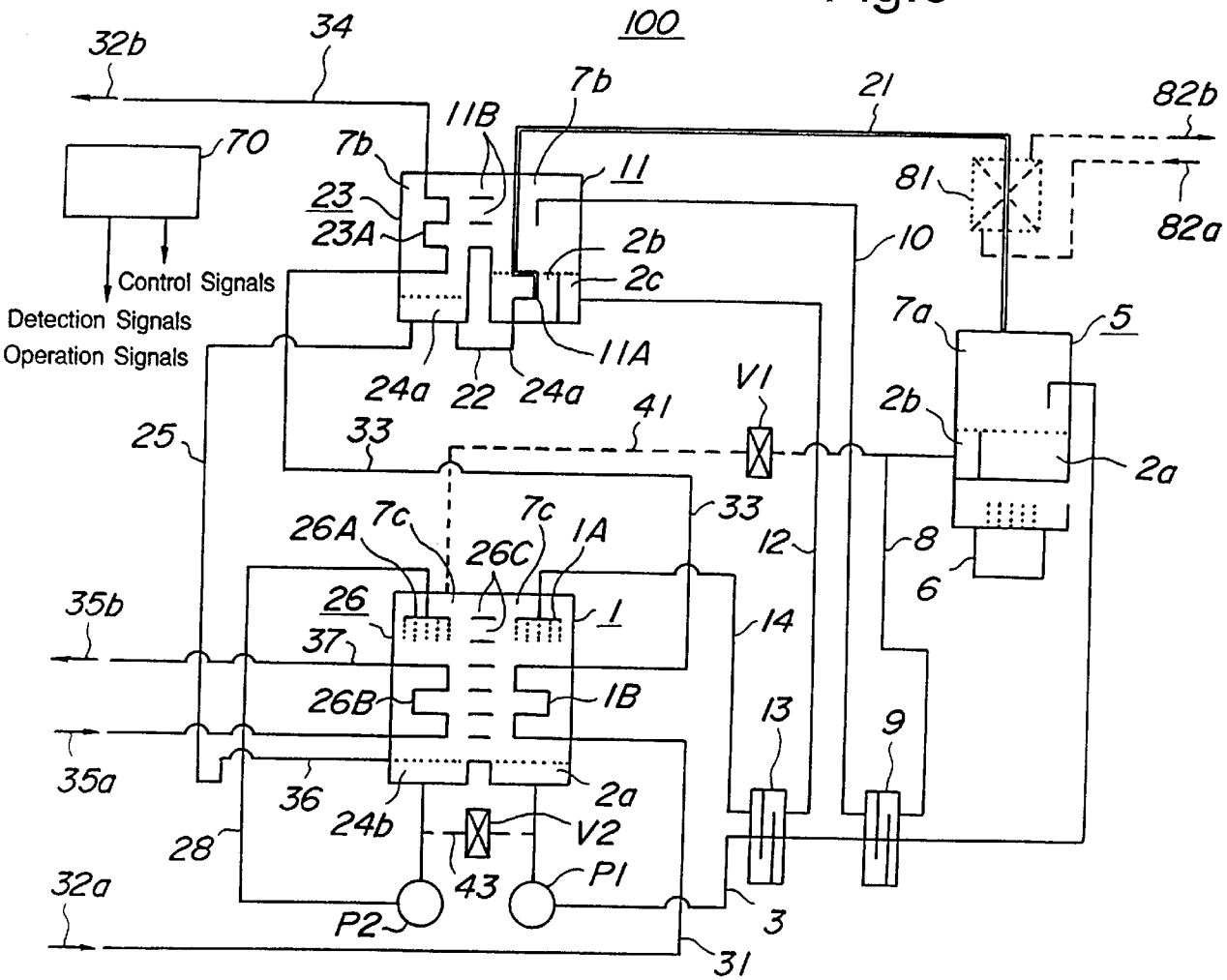

An embodiment of an absorption solution inflow passage is described with reference to FIGS. 4A and 4B. In FIGS. 4A and 4B, a dividing portion 3A is used to direct the diluted solution 2*a* from the pipe line 3 such that it flows directly into the liquid pipes 51 of the first group 51A and inflow holes 3B1 are formed in a partition wall 3B provided therein at positions corresponding to the liquid pipes 51 of the first group 51A.

Since the diluted solution 2*a* from the pipe line 3 is headed toward directions shown by arrows by the inflow holes 3B1 as shown by arrows in the section B—B, it first flows up through the flow passages 51*a* in the liquid pipes 51 as shown by the arrows and then flows down through the flow passages 50*a* and 50*b* between the exterior walls 50A and the interior walls 50B. As shown in FIGS. 1A to 1C and 2, when the volume of flames on both sides is made small, the diluted solution 2*a* flows in a downward direction through the flow passages 50*a* and 50*b* between the exterior walls 50A and the interior walls 50B in a well-balanced manner, thereby making it possible to prevent a corrosion accident.

[Summary Of Embodiments]

When the above embodiments are summarized, according to the first aspect of the present invention, the absorption type refrigerator 100, which employs the plane flame type burner of the first embodiment to evaporate refrigerant vapor 7*c* from a diluted absorption solution 2*a* by heating a heating chamber 63 in which vertical liquid pipes 51 for circulating the diluted absorption solution 2*a* are arranged in a matrix form within a horizontal plane with the combustion surface 60D2 of the plane flame type burner 60X, comprises a combustion surface forming means for forming the combustion surface 60D2 such that the width 60BX thereof within the horizontal plane is made smaller than the width 51BX of the liquid pipes 51 arranged in a matrix form to prevent the heating chamber 63 from overheating.

According to the second aspect of the present invention, the absorption type refrigerator, which employs the plane flame type burner of the first and second embodiments, comprises a combustion surface forming means for forming the combustion surface 60D2 such that the volume of flames on combustion surface 60D2 within the horizontal plane is made large at a central portion BY and small at portions on wall sides by changing, for example, the number of guide pores 60D1 per unit area or the diameter of each of the guide pores 60D1 to prevent the heating chamber 63 from overheating in place of the combustion surface forming means of the first aspect.

According to the third aspect of the present invention, the absorption type refrigerator, which employs the plane flame type burner of the first embodiment, comprises a combustion surface forming means for forming the combustion surface 60D2 such that the volume of flames on the combustion surface 60D2 within the horizontal plane is made large at a central portion BY and is reduced stepwise from the central portion to portions on the wall sides by changing, for example, the number of the guide pores 60D1 per unit area or the diameter of each of the guide pores 60D1 to prevent the heating chamber 63 from overheating in place of the combustion surface forming means of the first aspect.

According to the fourth aspect of the present invention, the absorption type refrigerator, which employs the plane flame type burner of the second embodiment, comprises a combustion surface forming means for forming the combustion surface 60D2 such that the volume of flames on the combustion surface 60D2 within the horizontal plane is made large at a central portion BY and is reduced gradually from the central portion to portions on the wall sides by changing, for example, the number of the guide pores 60D1 per unit area or the diameter of each of the guide pores 60D1 to prevent the heating chamber 63 from overheating in place of the combustion surface forming means of the first aspect.

According to the fifth aspect of the present invention, the absorption type refrigerator, which employs the plane flame type burner of the third and fourth embodiments, comprises a combustion surface forming means for forming the combustion surface 60D2 such that the volume of flames on the combustion surface 60D2 within a vertical plane is made large at an upper portion and small at a lower portion by changing, for example, the number of the guide pores 60D1 per unit area or the diameter of each of the guide pores 60D1 to prevent the heating chamber 63 from overheating in place of the combustion surface forming means of the first aspect.

According to the sixth aspect of the present invention, the absorption type refrigerator, which employs the plane flame type burner of the third embodiment, comprises a combustion surface forming means for forming the combustion surface 60D2 such that the volume of flames on the combustion surface 60D2 within the vertical plane is made large from a central portion BZ to an upper portion and is reduced stepwise from the central portion to a lower portion by changing, for example, the number of the guide pores 60D1 per unit area or the diameter of each of the guide pores 60D1 to prevent the heating chamber 63 from overheating in place of the combustion surface forming means of the first aspect.

According to the seventh aspect of the present invention, the absorption type refrigerator, which employs the plane flame type burner of the fourth embodiment, comprises a combustion surface forming means for forming the combustion surface 60D2 such that the volume of flames on the combustion surface 60D2 within the vertical plane is made large from a central portion BZ to an upper portion and is reduced gradually from the central portion to a lower portion by changing, for example, the number of the guide pores 60D1 per unit area or the diameter of each of the guide pores 60D1 to prevent the heating chamber 63 from overheating in place of the combustion surface forming means of the first aspect.

[Modification]

The following modification is included in the scope of the present invention.

Figure 6A:
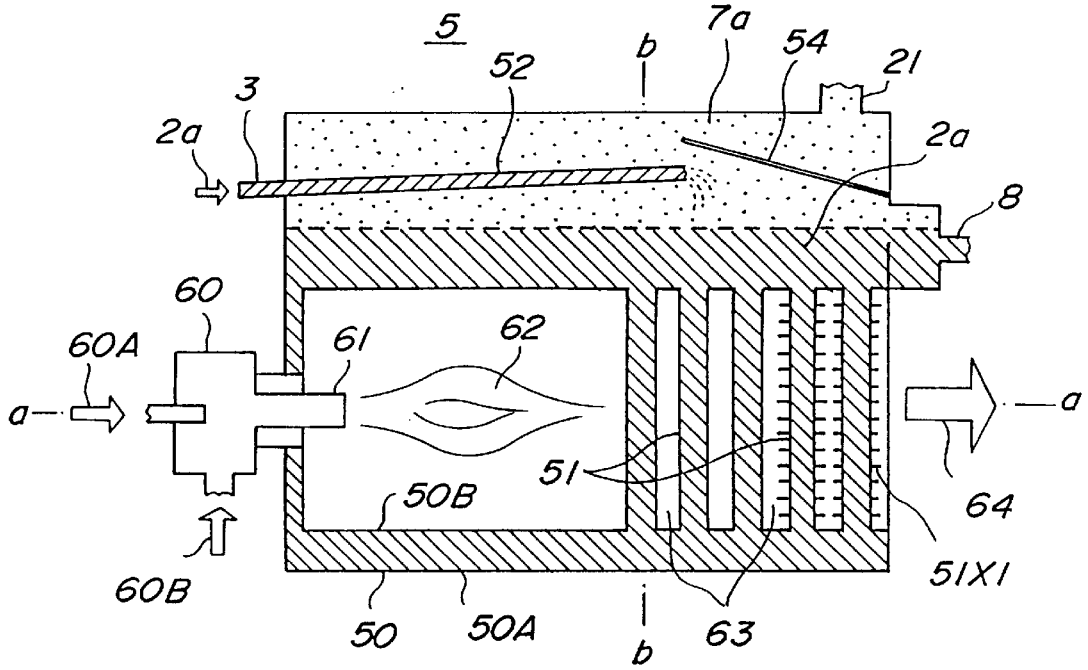
FIGS. 6A, 6B and 6C are front longitudinal sectional view, plan transverse sectional view and side longitudinal sectional view of key parts, respectively.
Figure 6B:
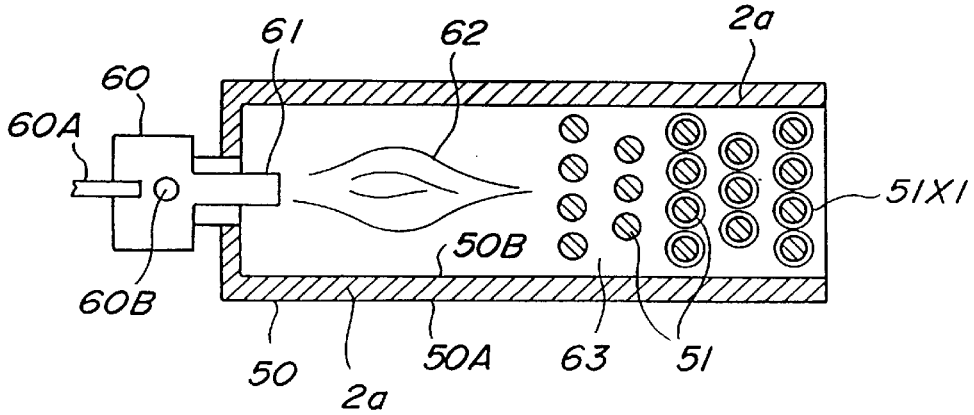
PRIOR ART Fig.6B
Figure 6C:
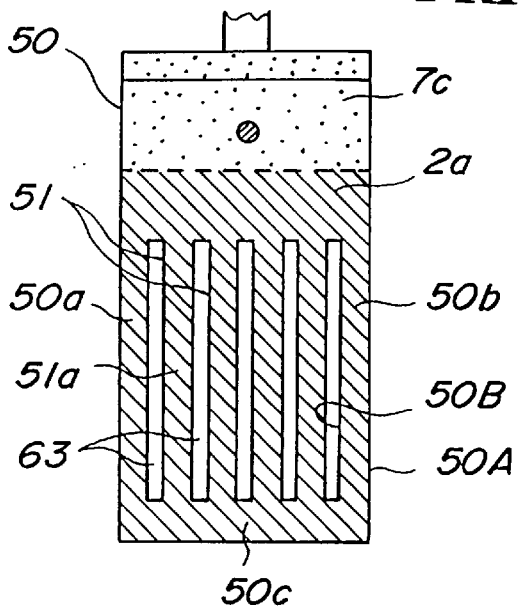
Fig.6C PRIOR ART
Figure 7:
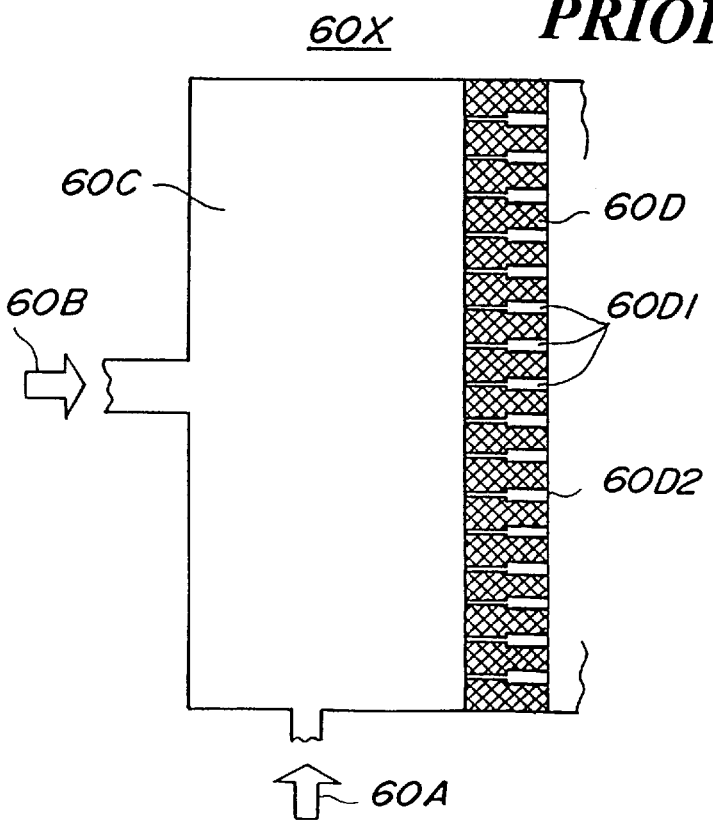
Fig.7 PRIOR ART

(1) An absorption type refrigerator in which the same bypassing plate 54 as in FIGS. 6A to 6C is provided below the pipe line 21 for discharging the refrigerant vapor 7*a*.

According to the present invention, as described above, since the heating chamber of the high-temperature regenerator for evaporating refrigerant vapor from the diluted absorption solution is heated with the plane flame type burner and the volume of flames on the combustion surface of the plane flame type burner is made small at portions on the sides of the side walls and the bottom wall of the heating chamber and large at the central portion within the horizontal plane and at an upper portion within the vertical plane, the diluted solution circulating in the heating chamber can flow in a well-balanced manner without being locally heated intensely. Therefore, a corrosion accident caused by a local rise in the temperature of the interior walls can be prevented.

Since the plane flame type burner can be arranged very close to the liquid pipes arranged in the heating chamber for circulating and heating the diluted solution, the diluted solution can be heated efficiently and a compact and inexpensive absorption type refrigerator can be provided by reducing the size of the high-temperature regenerator.

What is claimed is:

1. An absorption type refrigerator having a generator in which refrigerant vapor is evaporated from a mixed liquid component of refrigerant and an absorption solution by heating said mixed liquid component, said generator comprising:

exterior walls thereof for storing said mixed liquid component;

a burner chamber having a combustion surface of a plane flame type burner; and a plurality of pipes vertically arranged within said exterior walls for circulating said mixed liquid component vertically, said burner chamber being formed through said pipes wherein the horizontal width of said combustion surface is made smaller than the horizontal dispersion width of said arranged pipes.

2. An absorption type refrigerator in which refrigerant vapor is evaporated from a diluted absorption solution by heating a heating chamber in which vertical liquid pipes for circulating the diluted absorption solution are arranged in a matrix form within a horizontal plane with a combustion surface of a plane flame type burner, comprising:

a combustion surface forming means for forming the combustion surface such that the volume of flames on the combustion surface within the horizontal plane is made large at a central portion and small at portions on wall sides to prevent the heating chamber from overheating.

3. An absorption type refrigerator in which refrigerant vapor is evaporated from a diluted absorption solution by heating a heating chamber in which vertical liquid pipes for circulating the diluted absorption solution are arranged in a matrix form within a horizontal plane with a combustion surface of a plane flame type burner, comprising:

a combustion surface forming means for forming the combustion surface such that the volume of flames on the combustion surface within the horizontal plane is made large at a central portion and is reduced stepwise from the central portion to portions on wall sides to prevent the heating chamber from overheating.

4. An absorption type refrigerator having a generator in which refrigerant vapor is evaporated from a mixed liquid component of refrigerant and an absorption solution by heating said mixed liquid component, said generator comprising:

exterior walls thereof for storing said mixed liquid component;

a burner chamber having a combustion surface of a plane flame type burner; and a plurality of pipes vertically arranged within said exterior walls for circulating said mixed liquid component vertically, said burner chamber being formed through said pipes, wherein flame generated from said combustion surface of said plane flame type burner is arranged so as to heat said pipes in a predetermined heating range.

5. An absorption type refrigerator in which refrigerant vapor is evaporated from a diluted absorption solution by heating a heating chamber in which vertical liquid pipes for circulating the diluted absorption solution are arranged in a matrix form within a horizontal plane with a combustion surface of a plane flame type burner, comprising:

a combustion surface forming means for forming the combustion surface such that the volume of flames on the combustion surface within a vertical plane is made large at an upper portion and small at a lower portion to prevent the heating chamber from overheating.

6. An absorption type refrigerator in which refrigerant vapor is evaporated from a diluted absorption solution by heating a heating chamber in which vertical liquid pipes for circulating the diluted absorption solution are arranged in a matrix form within a horizontal plane with a combustion surface of a plane flame type burner, comprising:

a combustion surface forming means for forming the combustion surface such that the volume of flames on the combustion surface within a vertical plane is made large from a central portion to an upper portion and is reduced stepwise from the central portion to a lower portion to prevent the heating chamber from overheating.

7. An absorption type refrigerator in which refrigerant vapor is evaporated from a diluted absorption solution by heating a heating chamber in which vertical liquid pipes for circulating the diluted absorption solution are arranged in a matrix form within a horizontal plane with a combustion surface of a plane flame type burner, comprising:

a combustion surface forming means for forming the combustion surface such that the volume of flames on the combustion surface within a vertical plane is made large from a central portion to an upper portion and is reduced gradually from the central portion to a lower portion to prevent the heating chamber from overheating.

* * * * *